US009647428B2

(12) United States Patent
Deguchi

(10) Patent No.: US 9,647,428 B2
(45) Date of Patent: May 9, 2017

(54) SPARK PLUG FOR INTERNAL COMBUSTION ENGINE

(71) Applicant: DENSO CORPORATION, Karyiya, Aichi-pref. (JP)

(72) Inventor: Masataka Deguchi, Obu (JP)

(73) Assignee: DENSO CORPORATION, Kariya (JP)

( * ) Notice: Subject to any disclaimer, the term of this patent is extended or adjusted under 35 U.S.C. 154(b) by 56 days.

(21) Appl. No.: 14/874,981

(22) Filed: Oct. 5, 2015

(65) Prior Publication Data

US 2016/0099551 A1 Apr. 7, 2016

(30) Foreign Application Priority Data

Oct. 7, 2014 (JP) ..... 2014-206656

(51) Int. Cl.

| | |
|---|---|
| ***H01T 13/20*** | (2006.01) |
| ***H01T 13/41*** | (2006.01) |
| ***H01T 13/16*** | (2006.01) |
| ***H01T 13/32*** | (2006.01) |
| ***H01T 13/34*** | (2006.01) |

(52) U.S. Cl.

CPC ..... *H01T 13/41* (2013.01); *H01T 13/16* (2013.01); *H01T 13/32* (2013.01); *H01T 13/34* (2013.01)

(58) Field of Classification Search

CPC ..... H01T 13/34; H01T 13/32; H01T 13/16
USPC ..... 313/141, 136, 143, 145
See application file for complete search history.

(56) References Cited

U.S. PATENT DOCUMENTS

2013/0264939 A1 10/2013 Fukushima et al.
2016/0064903 A1 3/2016 Deguchi et al.

FOREIGN PATENT DOCUMENTS

JP 4901990 1/2012

*Primary Examiner* — Vip Patel
(74) *Attorney, Agent, or Firm* — Nixon & Vanderhye PC

(57) ABSTRACT

A spark plug includes a tubular housing, a tubular insulator, a center electrode, a ground electrode, a resistor, and a stem. The insulator is supported inside the housing. The center electrode is supported inside the insulator so as a distal end portion thereof protrudes. The ground electrode forms a spark discharge gap G between the ground electrode and the center electrode. The resistor is supported inside the insulator at a proximal side of the central electrode. The stem is supported inside of the insulator at a proximal side of the resistor. Of an outer peripheral surface of the insulator, and closer to a distal end side than a proximal portion of the resistor is, there is formed a high emissivity surface of which thermal emissivity is at least 0.7 on at least a part of a portion facing an inner circumferential surface of the housing.

8 Claims, 8 Drawing Sheets

SPARK PLUG FOR INTERNAL COMBUSTION ENGINE

CROSS-REFERENCE TO RELATED APPLICATION

This application is based on and claims the benefit of priority from earlier Japanese Patent Application No. 2014-206656 filed Oct. 7, 2014, the description of which is incorporated herein by reference.

TECHNICAL FIELD

The present disclosure relates to a spark plug for an internal combustion engine used in an engine of an automobile, etc.

BACKGROUND

A spark plug for an internal combustion engine includes a cylindrical housing, a cylindrical insulator that is supported inside the housing, a center electrode supported inside of the insulator so as a distal end portion thereof protrudes, and a ground electrode that forms a spark discharge gap between the ground electrode and the center electrode.

In such a spark plug, with a spark discharge that occurs in the above-mentioned spark discharge gap, radio noise is generated from the center electrode, and this may affect peripheral equipment.

In order to improve a capability of preventing this radio noise (noise suppression performance), there is known a device to which a resistor is disposed on a proximal side of the center electrode (refer to Japanese Patent Publication No. 4901990, for example).

However, there are following problems to the spark plug for the internal combustion engine mentioned above.

In recent years, for the purpose of improving fuel consumption of the internal combustion engine, the adoption of supercharging or the increasing of the compression ratio has been studied.

Accordingly, there is a tendency that the temperature in a combustion chamber increases.

In this case, the temperature of a distal end portion of the spark plug exposed to the combustion chamber is likely to be high, and the heat of the distal end portion is easily transmitted from the center electrode to the resistor disposed in the proximal side.

Therefore, the temperature of the resistor is also likely to be high.

Accordingly, materials constituting the resistor are easily oxidized, thus there is a risk that a resistance value of the resistor may increase.

As a result, electric discharge sparks are not easily generated, and this can lead to a misfire in the internal combustion engine.

Here, in order to prevent the resistors from easily becoming hot, it is considered to keep the resistor away from the distal end of the center electrode to the proximal side.

However, from a viewpoint of noise suppression performance, it is not preferable to keep the resistor away from the distal end of the center electrode.

SUMMARY

An embodiment provides a spark plug for an internal combustion engine that can suppress the temperature of the resistor from rising, while ensuring noise suppression performance.

A spark plug for an internal combustion engine according to a first aspect includes a tubular housing, a tubular insulator supported inside the housing, a center electrode supported inside the insulator so that a distal end portion, which is a portion inserted into a combustion chamber of the internal combustion engine, of the center electrode protrudes, a ground electrode that forms a spark discharge gap between the ground electrode and the center electrode, a resistor supported inside the insulator at a proximal side, which is a side opposite to the distal end, of the central electrode, and a stem supported inside the insulator at a proximal side of the resistor.

Of an outer peripheral surface of the insulator, and closer to a distal end side than a proximal portion of the resistor is, there is formed a high emissivity surface of which thermal emissivity is at least 0.7 on at least a part of a portion facing an inner circumferential surface of the housing.

In the spark plug for the internal combustion engine, the high emissivity surface with the thermal emissivity of at least 0.7 is formed on the predetermined portion of the outer peripheral surface of the insulator.

Therefore, the heat of the center electrode can be easily transferred to the housing through the insulator.

That is, while the heat of the center electrode is transferred to the resistor disposed in its proximal side, the heat is released by being transferred to the housing through the insulator disposed on the outer peripheral side of the center electrode.

Here, generally, since a clearance is formed between the outer peripheral surface of the insulator and the inner peripheral surface of the housing, the heat transfer to the housing from the insulator is mainly due to the heat released through the air.

Therefore, by forming the high emissivity surface on the outer peripheral surface of the insulator, it becomes easy to efficiently release the heat transferred to the insulator from the center electrode through the outer peripheral surface of the insulator.

As a result, it becomes easy to release the heat of the center electrode to the housing via the insulator.

Thereby, it becomes easy to suppress the temperature of the resistor from rising.

Further, in connection with this, it is not necessary to dispose the resistor away from the distal end of the center electrode to the distal end side, it is possible to ensure noise suppression performance.

As described above, according to the present disclosure, while ensuring noise suppression performance, it is possible to provide a spark plug for the internal combustion engine capable of suppressing the temperature of the resistor from rising.

DETAILED DESCRIPTION OF THE PREFERRED EMBODIMENTS

A spark plug for an internal combustion engine may be used for an internal combustion engine of an automobile, or a cogeneration system, for example.

In addition, in the plug axial direction, a side of the spark plug to be inserted into a combustion chamber of the internal combustion engine is defined as a distal end side, and an opposite side thereof is defined as a proximal side in the present specification.

EMBODIMENTS

First Embodiment

An embodiment of a spark plug for an internal combustion engine will be described with reference to FIGS. 1 to 5.

Figure 1:
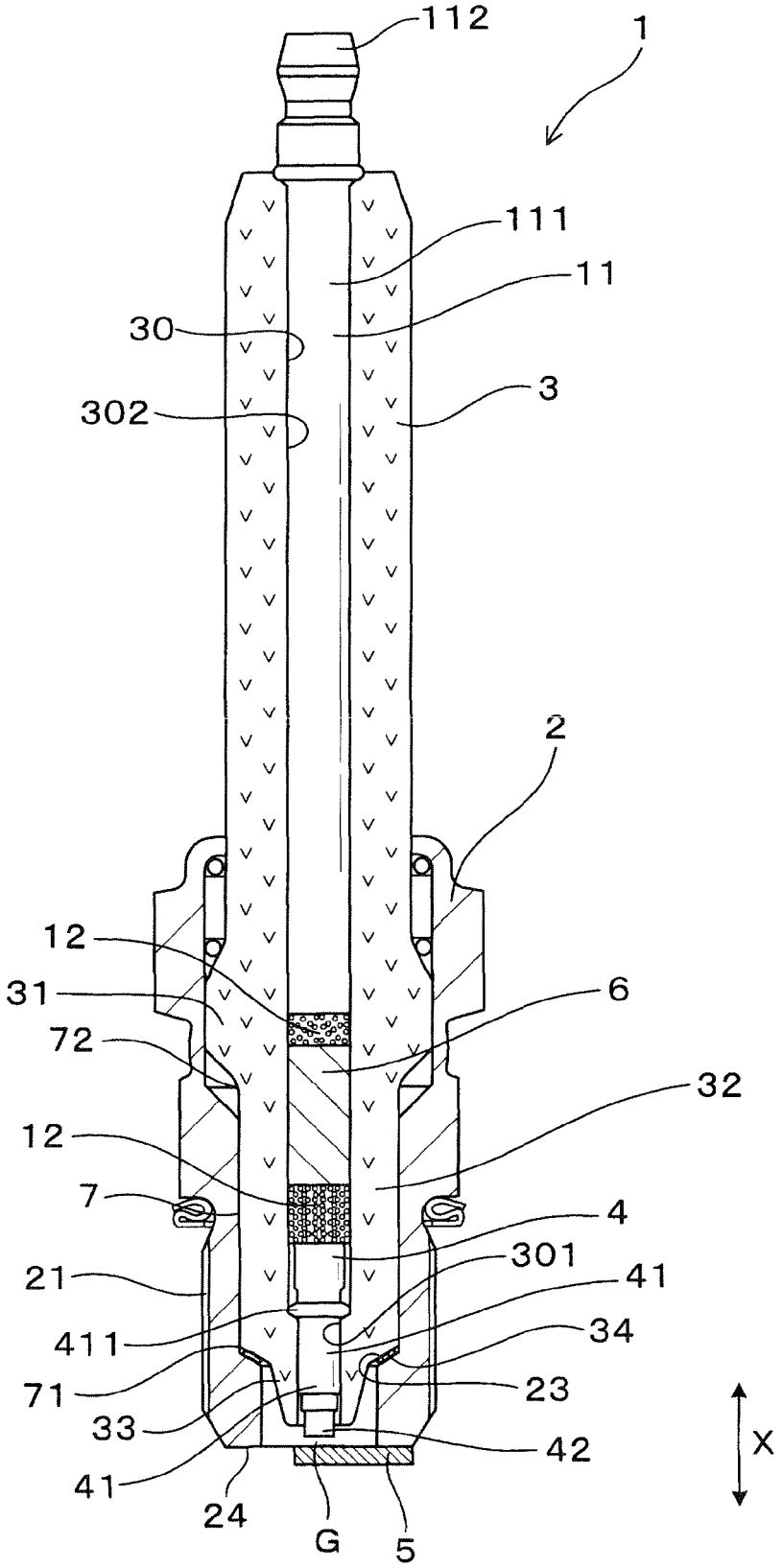
FIG. 1 shows a sectional view of a spark plug according to a first embodiment.

An spark plug 1 for an internal combustion engine of the present embodiment has a tubular housing 2, a tubular insulator 3, a center electrode 4, a ground electrode 5, a resistor 6, and a stem 11, as shown in FIG. 1.

The insulator 3 is supported inside the housing 2.

The center electrode 4 is supported inside the insulator 3 so that a distal end portion thereof protrudes.

The ground electrode 5 forms a spark discharge gap G between the ground electrode 5 and the center electrode 4.

The resistor 6 is supported inside the insulator 3 at a proximal side of the center electrode 4.

The stem 11 is supported inside the insulator 3 at a proximal side of the resistor 6.

Figure 2:
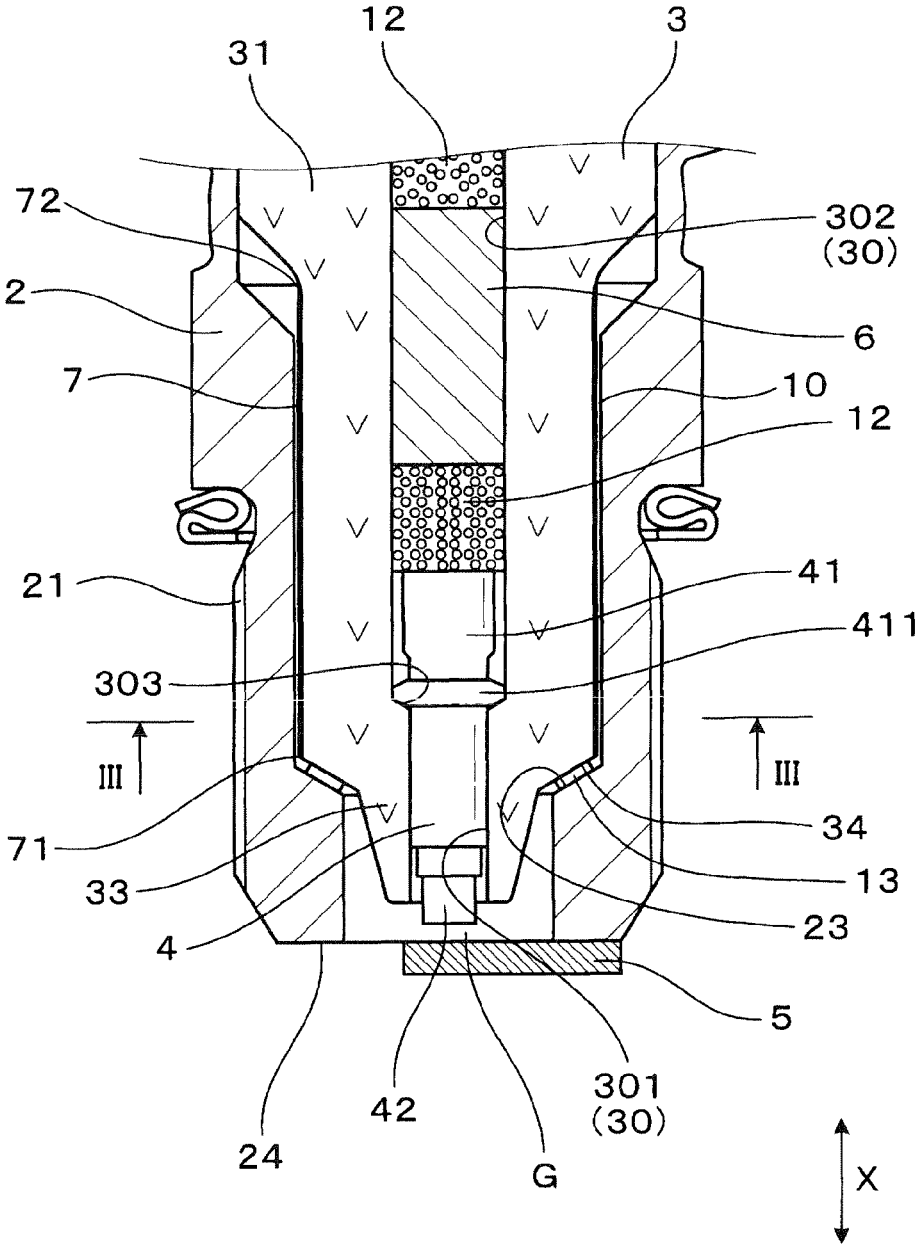
FIG. 2 shows an enlarged sectional view of a distal end portion of the spark plug in the first embodiment.

As shown in FIGS. 1 and 2, of an outer peripheral surface of the insulator 3, and closer to a distal end side than a proximal portion of the resistor 6 is, there is formed a high emissivity surface 7 of which thermal emissivity is at least 0.7 on at least a part of a portion facing an inner circumferential surface of the housing 2.

The housing 2 has a mounting threaded portion 21 for mounting the spark plug 1 to the internal combustion engine.

The housing 2 is made of Fe based alloy, for example.

Further, the insulator 3 has a locked step portion 34 that is locked in a plug axial direction X relative to a locking step portion 23 disposed on an inner peripheral side of the housing 2.

An annular packing 13 is interposed between the locked step portion 34 of the insulator 3 and the locking step portion 23 of the housing 2.

Then, the insulator 3 is supported in the housing 2 in a condition where the locked step portion 34 of the insulator 3 is in contact with the locking step portion 23 of the housing 2 via the packing 13 in the plug axial direction X.

The insulator 3 is made by forming alumina, for example, in a substantially cylindrical shape.

The insulator 3 has a large outer diameter portion 31, a small outer diameter portion 32, and a leg portion 33 whose outer diameters differ from each other disposed in the plug axial direction X.

The large outer diameter portion 31 has a larger outer diameter than other portions of the insulator 3.

The small outer diameter portion 32 is positioned on the distal end side of the large outer diameter portion 31, and has a smaller outer diameter than the large outer diameter portion 31.

The leg portion 33 is positioned on the distal end side of the small outer diameter portion 32, and has a smaller outer diameter than the small outer diameter portion 32.

Further, the outer diameter of the leg portion 33 becomes smaller as reaching toward the distal end side.

The locked step portion 34 of which the outer diameter becomes smaller toward the distal end is formed between the small outer diameter portion 32 and the leg portion 33.

As shown in FIGS. 1 and 2, an outer peripheral surface of the small outer diameter portion 32 of the insulator 3 and at least a part of the inner peripheral surface of the housing 2 face each other.

Figure 3:
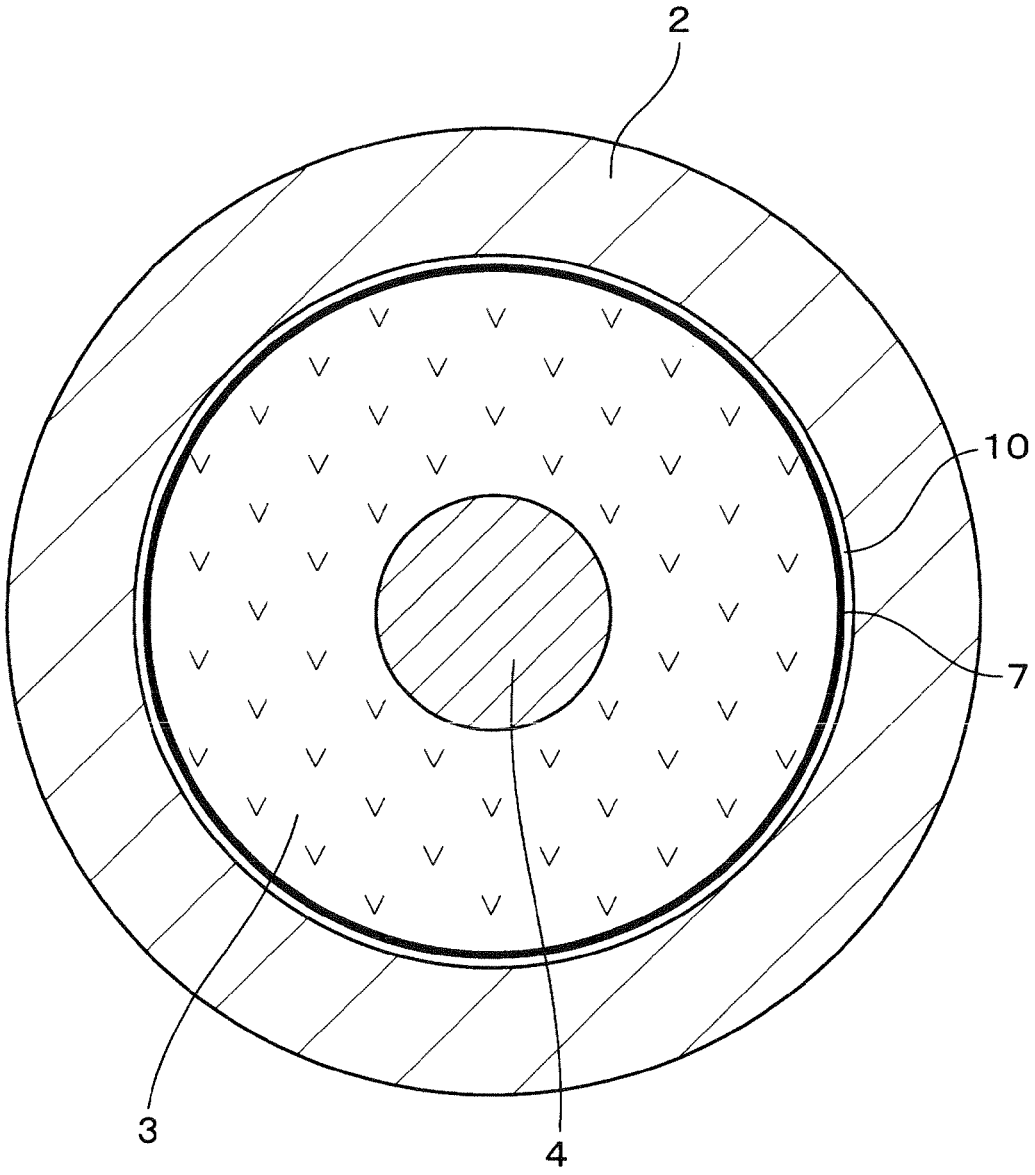
FIG. 3 shows a sectional view taken along the line III-III of FIG. 2.
Figure 5:
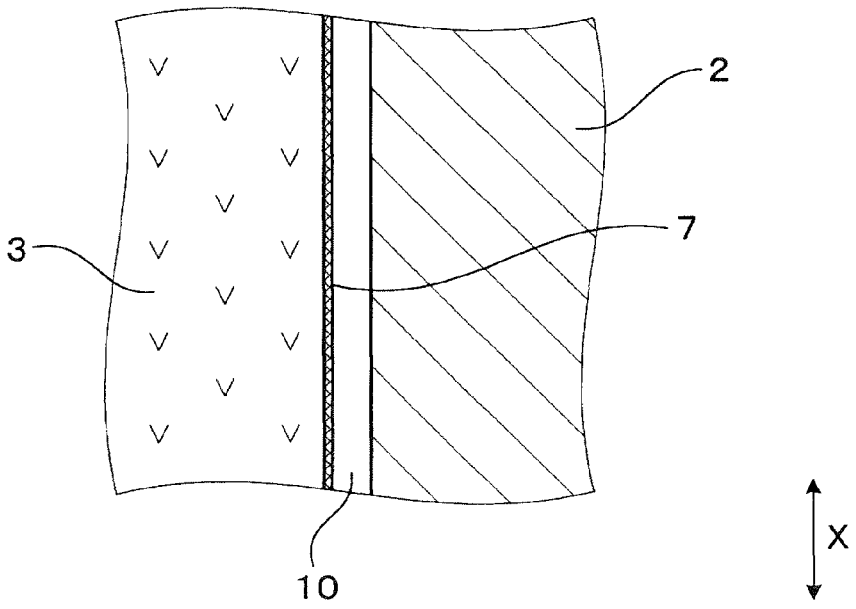
FIG. 5 shows an enlarged sectional view between the insulator to which the high emissivity surface is formed and a housing in the first embodiment.

As shown in FIGS. 3 and 5, a slight clearance 10 (air layer) is formed between the inner peripheral surface of the housing 2 and the outer peripheral surface of the small outer diameter portion 32 of the insulator 3, and the inner peripheral surface of the housing 2 and the outer peripheral surface of the small outer diameter portion 32 are not in close contact.

The high emissivity surface 7 is formed on the outer peripheral surface of the insulator 3 that faces the clearance 10.

Figure 4:
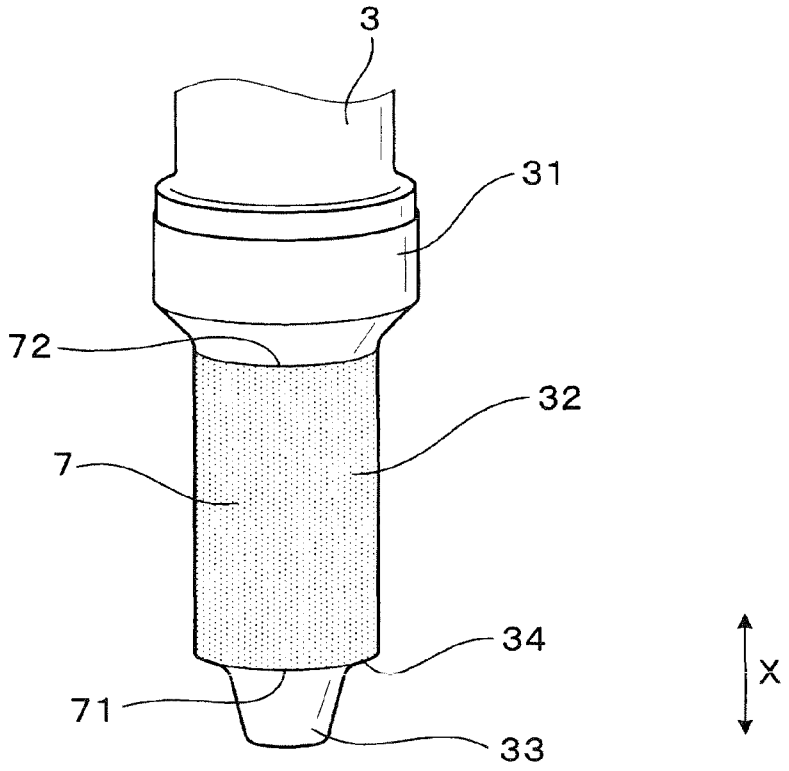
FIG. 4 shows a perspective view of a distal end portion of an insulator to which a high emissivity surface is formed in the first embodiment.

In the present embodiment, as shown in FIGS. 2 to 4, the high emissivity surface 7 is formed on an entire region of the outer peripheral surface of the small outer diameter portion 32 of the insulator 3.

The high emissivity surface 7 is formed by coating a high emissivity material having 0.7 or more thermal emissivity on the outer peripheral surface of the insulator 3.

For such a high emissivity material, for example, there is an oxide ceramic paint made by Okitsumo Inc., a black body compounding paint made by Tasco Japan Co. Ltd., or the like.

It should be noted that, for the high emissivity material, a black body tape made by Tasco Japan Co. Ltd. can also be stuck onto the outer peripheral surface of the insulator 3.

Here, the thermal emissivity of an object is a ratio of an energy of the light that a black body of a certain temperature emits (black body radiation) relative to an energy of the light that the black body of the same temperature emits by thermal radiation (radiance), and it is a dimensionless quantity.

As shown in FIG. 1, an axial hole 30 for insert-supporting the center electrode 4 is disposed on an inner side of the insulator 3 penetrating in the plug axial direction X.

The axial hole 30 has a small diameter hole portion 301 at its distal end, and the axial hole 30 has a large diameter hole portion 302 formed larger in diameter than the small diameter hole portion 301 at more proximal side than the small diameter hole portion 301 is.

Then, as shown in FIG. 2, an electrode support portion 303 having an outer diameter getting smaller toward its distal end side is formed between the small diameter hole portion 301 and the large diameter hole portion 302.

The center electrode 4 is supported in the insulator 3 in a condition where the center electrode 4 is supported by the electrode support portion 303 in the plug axial direction X.

As shown in FIGS. 1 and 2, the center electrode 4 is composed of a center electrode base material 41 and a noble metal tip 42 joined to a distal end thereof.

The noble metal tip 42 has a cylindrical shape, and is joined to the distal end of the center electrode base material 41 by welding or the like.

The center electrode base material 41 has a flange portion 411 projecting radially outwardly at its proximal.

The center electrode 4 is supported by the insulator 3 in a condition where the flange portion 411 is supported by the electrode support portion 303 of the insulator 3 in the plug axial direction X.

The resistor 6 is disposed at a proximal side of the center electrode 4 via a conductive glass seal 12.

The glass seal 12 is made of a copper glass formed by mixing copper powder (Cu) into the glass.

The resistor 6 is formed by heat sealing resistor compositions comprising at least a resistive material such as a carbon or ceramic powder and glass powder.

Alternatively, the resistor 6 can be configured by inserting a cartridge-type resistor.

The stem 11 is disposed to the proximal side of the resistor 6 via the glass seal 12 made of copper glass.

The stem 11 has a stem body 111 insert-supported inside the insulator 3, and a terminal 112 exposed from the insulator 3 at the proximal of the stem body 111 and which is connected with an ignition coil (not shown).

The stem 11 is, for example, made of an iron alloy.

The ground electrode 5 is disposed at a distal end surface 24 of the housing 2.

The ground electrode 5 extends straight toward the plug center axis from the distal end surface 24 of the housing 2 in a direction perpendicular to the plug axis X.

Then, the ground electrode 5 is facing to a distal end surface of the center electrode 4 in the plug axial direction X.

Thus, the spark discharge gap G is formed between the center electrode 4 and the ground electrode 5.

Next, a positional relationship between the high emissivity surface 7, the resistor 6, each part of the housing 2, and the center electrode 4 in the plug axial direction X will be explained.

As shown in FIGS. 1 and 2, in the present embodiment, of the outer peripheral surface of the insulator 3, and closer to the distal end side than the proximal portion of the resistor 6 is, there is formed the high emissivity surface 7 on at least a part of the portion facing the inner circumferential surface of the housing 2.

In addition, the high emissivity surface 7 is disposed so as to partially overlap with the center electrode base metal 41 and the resistor 6 in a plug radial direction.

That is, in the plug axial direction X, a distal end 71 of the high emissivity surface 7 is positioned at the same position as a part of the center electrode base material 41 in the distal end side closer than the flange portion 411 is, and a proximal 72 of the high emissivity surface 7 is positioned between the distal end and the proximal of the resistor 6.

Further, as shown in FIGS. 1 and 2, the high emissivity surface 7 is disposed so as to at least partially overlap with the mounting threaded portion 21 of the housing 2 in the plug radial direction.

Furthermore, as shown in FIG. 3, the high emissivity surface 7 is formed on the entire periphery of the insulator 3.

Next, an example of a method for measuring the emissivity of the high emissivity surface 7 will be described.

First, the temperature of the high emissivity surface 7 is measured by a contact type temperature sensor, a thermocouple, or the like.

A measured temperature value here will be called an actual measured temperature value in the following.

Next, in a radiation thermometer equipped with a non-contact type temperature sensor, an arbitrary thermal emissivity is set in advance, and the temperature of the high emissivity surface 7 is measured.

If the measured temperature value here is different from the actual measured temperature value, the emissivity that has been set by the radiation thermometer is changed.

In other words, a setting value of the thermal emissivity of the radiation thermometer is adjusted so that the temperature value measured by the radiation thermometer becomes equal to the actual measured temperature value.

For example, when the temperature value that the radiation thermometer indicated is lower than the actual measured temperature value, the thermal emissivity that has been set in the radiation thermometer is changed to a lower value.

Then, the setting value of the thermal emissivity of the radiation thermometer when the temperature value of the high emissivity surface 7 indicated by the radiation thermometer became equal to the actual measured temperature value is the thermal emissivity of the high emissivity surface 7.

In this way, it is possible to measure the thermal emissivity of the high emissivity surface 7.

Next, functions and effects of the present embodiment will be explained.

In the spark plug 1 for the internal combustion engine, the high emissivity surface 7 with the thermal emissivity of at least 0.7 is formed on the predetermined portion of the outer peripheral surface of the insulator 3.

Therefore, the heat of the center electrode 4 is released from the high emissivity surface 7 of the outer peripheral surface of the insulator 3, and it is easy to release heat to the housing 2.

Thereby, it becomes easy to suppress the temperature of the resistor 6 from increasing.

In connection with this, it becomes unnecessary to dispose the resistor 6 away from the distal end of the center electrode 4 to the proximal side, and it is possible to ensure noise suppression performance.

Further, since the high emissivity surface 7 is formed on the distal end side closer than the distal end portion of the resistor 6 is, before the heat of the center electrode 4 is transferred to the resistor 6, the heat of the center electrode 4 can be easily released to the housing 2 via the insulator 3 disposed on the outer periphery side of the center electrode 4.

This makes it possible to reduce the heat transferred from the center electrode 4 to the resistor 6, and the resistor 6 can be prevented from becoming hot.

Moreover, the high emissivity surface 7 is formed closer to the proximal side than the locked step portion 34 is.

That is, in the plug axial direction X, the high emissivity surface 7 is formed between the locked step portion 34 and the proximal portion of the resistor 6.

Since the outer peripheral surface of the insulator 3 and the inner peripheral surface of the housing 2 are close in this portion, it is possible to effectively release the heat of the center electrode 4 to the housing 2 by forming the high emissivity surface 7 in this region.

As described above, according to the present embodiment, it is possible to provide the spark plug for the internal combustion engine capable of suppressing the temperature of the resistor from rising, while ensuring noise suppression performance.

Experimental Example

The present embodiment is an example of analyzing changes in the temperature of the distal end of the resistor 6 when the thermal emissivity of the outer peripheral surface of the small outer diameter portion 32 of the insulator 3 is variously changed in a spark plug having the same basic structure of the spark plug 1 of the first embodiment except the high emissivity surface 7.

Specifically, heat conduction analysis is conducted for six types of spark plugs each having the thermal emissivity of the outer peripheral surface of the small outer diameter portion 32 of the insulator 3 of 0.4, 0.5, 0.6, 0.7, 0.8, and 0.9, respectively.

It should be noted that the thermal emissivity 0.4 is equivalent to a thermal emissivity of the surface of the insulator 3 made of alumina.

Then, the temperature T of the distal end portion of the resistor 6 is analyzed with respect to each of the six types of spark plugs 1 when given a predetermined amount of heat from the surface of the distal end portion that is exposed to the combustion chamber when mounted to the internal combustion engine.

Figure 6:
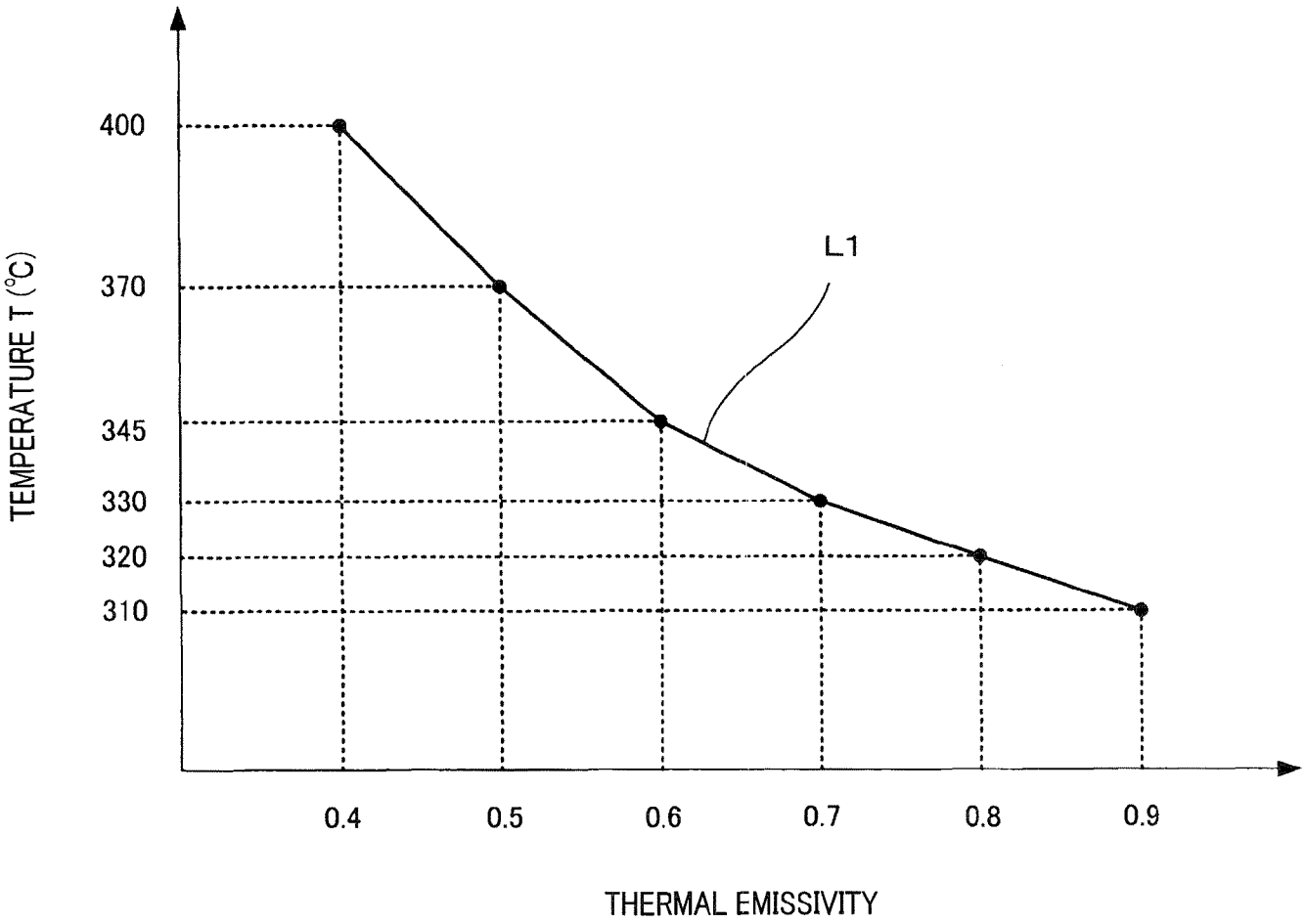
FIG. 6 shows a graph of a measurement result of the temperature of a distal end surface of a resistor of each sample in an experimental example.

The result is indicated by a polyline L1 in FIG. 6.

Here, the predetermined amount of heat mentioned above is an amount of heat substantially equal to an actual amount of heat that the distal end portion of the spark plug 1 receives from the combustion chamber of the internal combustion engine.

It can be seen from FIG. 6 that as the heat radiation rate increases, the temperature T lowers.

In particular, when the thermal emissivity is 0.7, in addition to that there is a point at which a slope of the polyline L1 starts to be small enough in FIG. 6, the temperature of the distal end of the resistor 6 can be reduced to 330 degrees C. that is a threshold that can ensure the durability and reliability of the resistor 6.

Moreover, by configuring the thermal emissivity to 0.8 or 0.9, it is possible to further lower the temperature T.

From this result, it can be said that it is possible to effectively prevent the temperature of the resistor 6 from rising when the thermal emissivity of the small outer diameter portion 32 of the insulator 3 is 0.7 or more.

Further, considering the variation of the use environment of the actual machine, the thermal emissivity of the small outer diameter portion 32 of the insulator 3 is preferably configured to 0.8 or more, and is further preferably configured to 0.9 or more.

In other words, from the results of present embodiment, it can be said that the temperature of the resistor 6 can be suppressed from rising by disposing the high, emissivity surface 7 having the thermal emissivity of 0.7 or more at the predetermined portion of the outer peripheral surface of the insulator 3.

Then, it can be said that it is preferable to configure the thermal emissivity of the high emissivity surface 7 to be 0.8 or more, and more preferable to be 0.9 or more.

Second Embodiment

Figure 7:
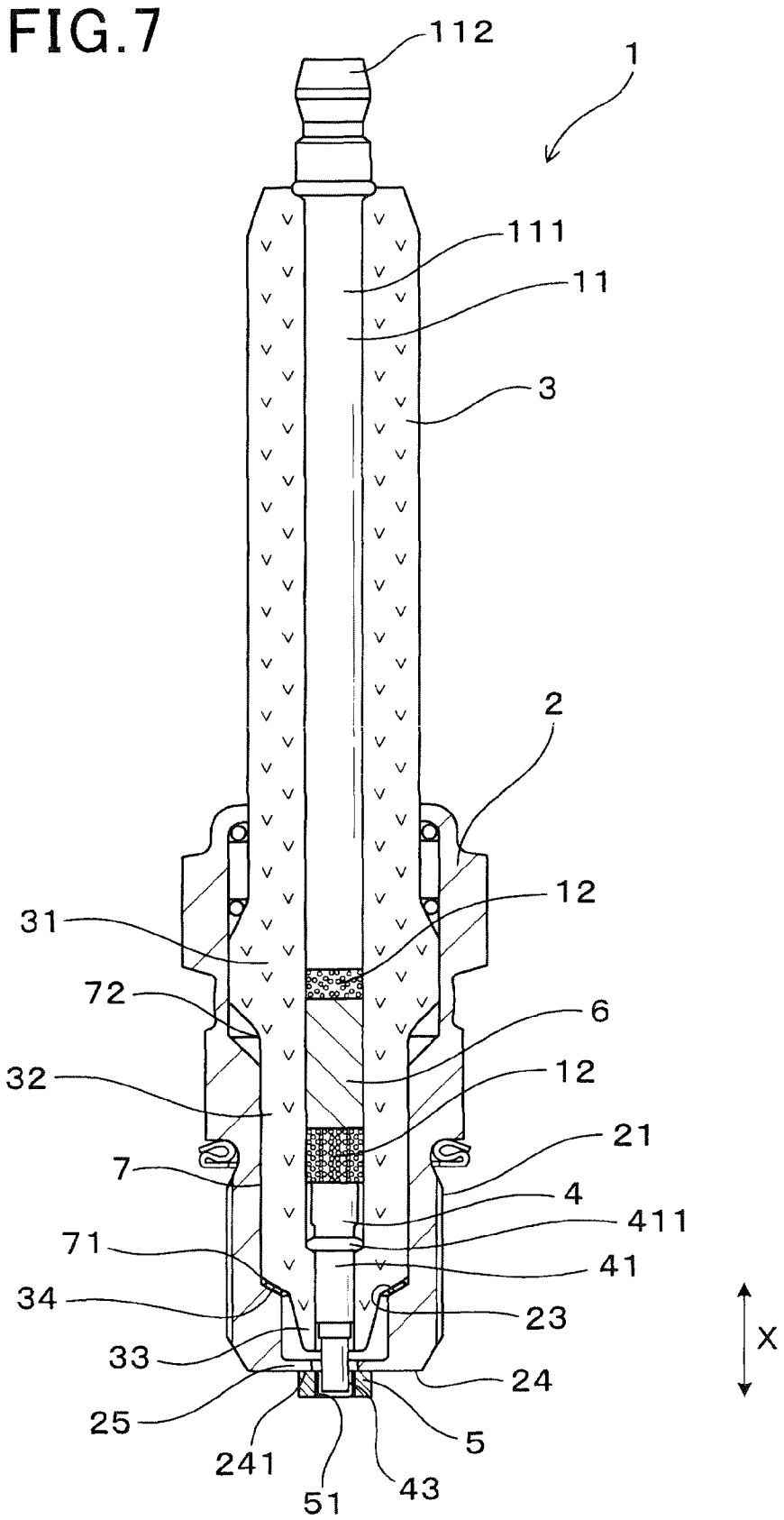
FIG. 7 shows a sectional view of a spark plug according to a second embodiment.
Figure 8:
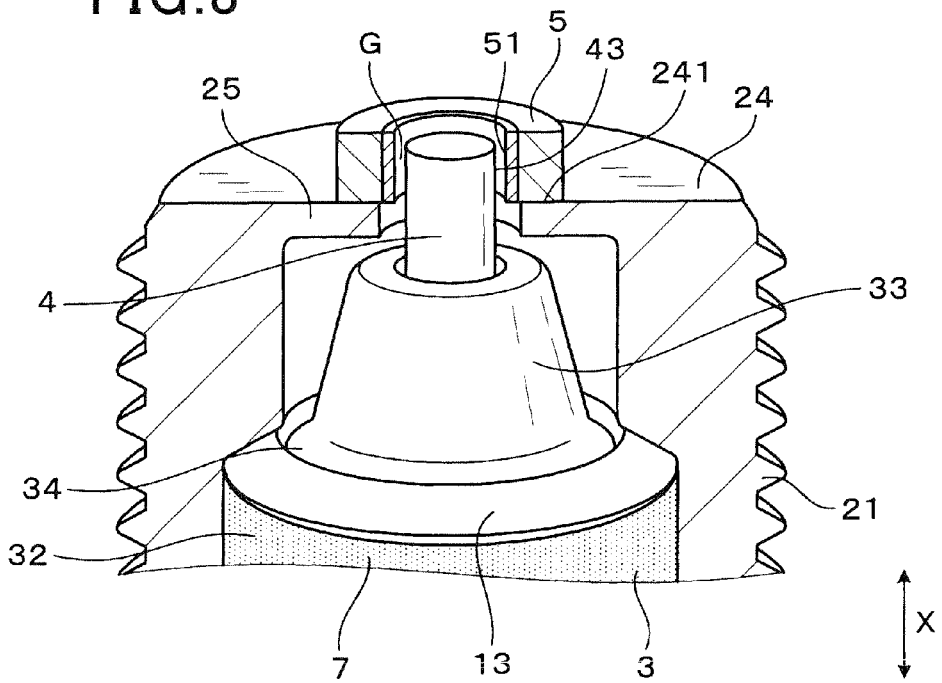
FIG. 8 shows a perspective sectional view of a vicinity of a distal end portion of the spark plug in the second embodiment.
Figure 9:
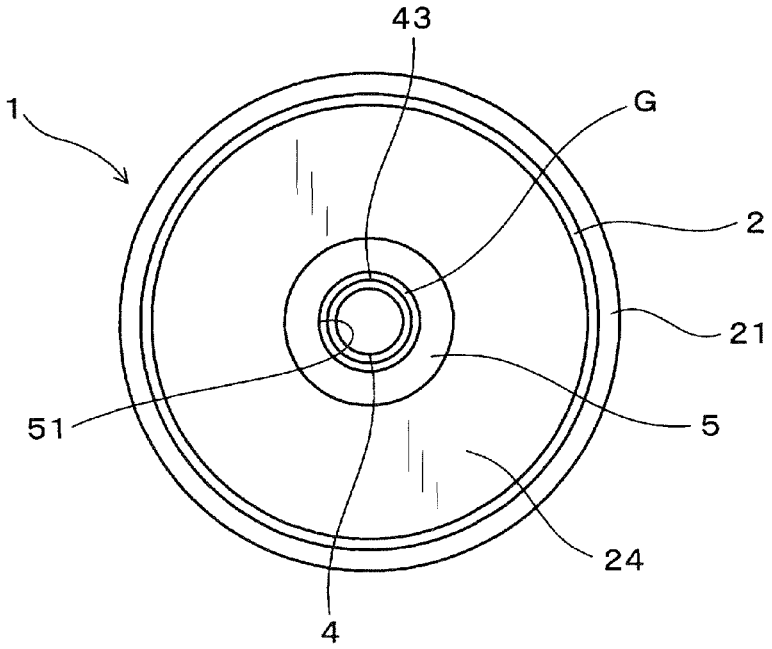
FIG. 9 shows a plan view of the spark plug as viewed from a distal end in the second embodiment.

As shown in FIGS. 7 to 9, the present embodiment is an example of changing shapes of the housing 2, the ground electrode 5, or the like with respect to the first embodiment.

The housing 2 has a reduced diameter portion 25 with an inner diameter smaller than all other portions at the distal end portion thereof.

The ground electrode 5 is disposed so as to protrude from a distal end face 241 of the reduced diameter portion 25, and is formed in a ring shape so that an inner peripheral surface 51 of the ground electrode 5 faces an outer peripheral surface 43 of the center electrode 4.

Accordingly, the housing 2 is configured so that the reduced diameter portion 25 covers the insulator 3 from the distal end side.

As shown in FIG. 9, the ground electrode 5 is disposed coaxially (plug center axis) with the housing 2.

The ground electrode 5 is joined in a condition that the proximal surface thereof is in surface contact with the front end surface 241 of the reduced diameter portion 25 of the housing 2.

As shown in FIGS. 7 to 9, an outer diameter of the ground electrode 5 is smaller than an outer diameter of the housing 2.

Further, an inner diameter of the ground electrode 5 is smaller than the inner diameter of the reduced diameter portion 25 of the housing 2.

As shown in FIGS. 7 and 8, the center electrode 4 is disposed inside the reduced diameter portion 25 of the housing 2 and the ground electrode 5.

That is, a spark discharge gap G of the present embodiment is positioned on a distal end side closer than the distal end surface 24 of the housing 2 is.

Then, the high emissivity surface 7 is, as in the first embodiment, formed on the entire region of the outer peripheral surface of the small outer diameter portion 32 of the insulator 3.

Furthermore, in the plug axial direction X, the front end 71 of the high emissivity surface 7 is in the same position as the front end side closer than the flange portion 411 of the center electrode base material 41 is, and the proximal 72 of the high emissivity surface 7 is in the position between the distal end and the proximal of the resistor 6.

Other features are the same as in the first embodiment.

It should be noted that among the reference numerals used in the drawings of the present embodiment or the drawings related to the present embodiment, the same reference numerals as used in the first embodiment represent the same elements as the first embodiment unless otherwise indicated.

In the case of present embodiment, since it is configured that the housing 2 has the reduced diameter portion 25 at its distal end, and the reduced diameter portion 25 covers the insulator 3 from the distal end side, the temperature of the insulator 3, the central electrode 4, and the resistor 6 tend to become high.

Accordingly, in the structure of the present embodiment, by disposing the high emissivity surface 7 on the outer peripheral surface of the insulator 3, and by obtaining the heat releasing effect from the insulator 3, it is possible to effectively prevent the temperature of the resistor 6 from rising.

Other features have the same functions and effects as in the first embodiment.

Third Embodiment

Figure 10:
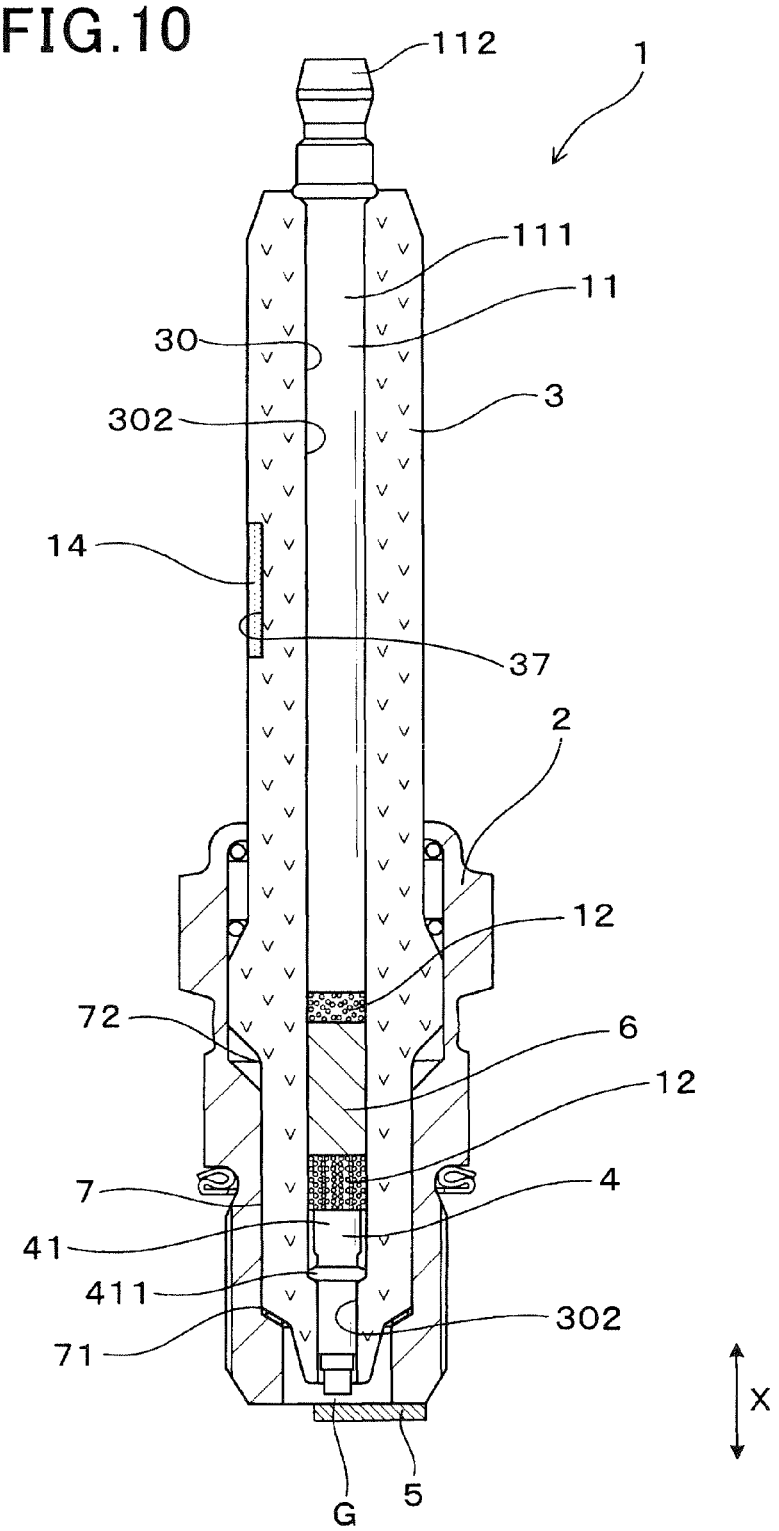
FIG. 10 shows a sectional view of a spark plug according to a third embodiment.

As shown in FIG. 10, the present embodiment is an example that a constant voltage element 14 is disposed in the insulator 3 closer to the distal end side than the housing 2 is.

The constant voltage element 14 is disposed in order to prevent a voltage more than a predetermined voltage from being applied to the spark discharge gap G, and is made of a Zener diode, for example.

The constant voltage element 14 is disposed in an element placement groove 37 formed on the outer peripheral surface of the insulator 3.

The constant voltage element 14 is disposed on the distal side closer than the resistor 6 is in the plug axial direction X.

Then, the high emissivity surface 7 is, as in the first embodiment, formed on the entire region of the outer peripheral surface of the small outer diameter portion 32 of the insulator 3.

Furthermore, in the plug axial direction X, the front end 71 of the high emissivity surface 7 is in the same position as the front end side than the flange portion 411 of the center electrode base material 41 is, and the proximal 72 of the high emissivity surface 7 is in the position between the distal end and the proximal of the resistor 6.

Others are the same as in the first embodiment.

It should be noted that among the reference numerals used in the drawings of the present embodiment or the drawings related to the present embodiment, the same reference numerals as used in the first embodiment represent the same elements as the first embodiment unless otherwise indicated.

Even when electronic components such as a constant voltage element 14 is disposed in the insulator 3 as in the present embodiment, it is possible to prevent the heat of the distal end of the center electrode 4 from being transferred to the constant voltage element 14, and it is possible to prevent the constant voltage element 14 from getting hot by forming the high emissivity surface 7 on the outer peripheral surface of the insulator 3.

That is, the heat insulator 3 is easily and effectively released from the outer peripheral surface of the insulator 3 to the clearance 10 (air layer).

Hence, it is possible to reduce the amount of heat transferred to the proximal side through the insulator 3 from the distal end of the center electrode 4.

As a result, it is possible to prevent the temperature of the constant voltage element 14 from getting high.

Others have the same functions and effects as in the first embodiment.

It should be noted that the present disclosure is not limited to the above embodiments and may adopt various aspects.

Moreover, as long as the high emissivity surface is disposed in the distal end side than the proximal portion of the resistor is among the outer peripheral surface of the insulator, and the high emissivity surface is disposed on at least a part of the portion facing the inner circumferential surface of the housing, it is not necessary to dispose the high emissivity surface on the entire region of the outer peripheral surface of the small outer diameter portion 32 of the insulator 3 as in the first to third embodiments.

What is claimed is:

1. A spark plug for an internal combustion engine comprising:

a tubular housing;

a tubular insulator supported inside the housing;

a center electrode supported inside the insulator so that a distal end portion, which is a portion inserted into a combustion chamber of the internal combustion engine, of the center electrode protrudes;

a ground electrode that forms a spark discharge gap between the ground electrode and the center electrode;

a resistor supported inside the insulator at a proximal side, which is a side opposite to the distal end, of the central electrode; and a stem supported inside the insulator at a proximal side of the resistor; wherein, of an outer peripheral surface of the insulator, and closer to a distal end side than a proximal portion of the resistor is, there is formed a high emissivity surface of which thermal emissivity is at least 0.7 on at least a part of a portion facing an inner circumferential surface of the housing.

2. The high spark plug for the internal combustion engine according to claim 1, wherein, of the outer peripheral surface of the insulator, and closer to the distal end side than a distal end portion of the resistor is, there is formed the high emissivity surface of which thermal emissivity is at least 0.7 on at least a part of a portion facing the inner circumferential surface of the housing.

3. The spark plug for the internal combustion engine according to claim 1, wherein, the insulator has a locked step portion that is locked in a plug axial direction relative to a locking step portion disposed on an inner peripheral side of the housing;

the high emissivity surface is formed closer to the proximal side than the locked step portion is; and the high emissivity surface is disposed on at least a part of the portion facing the inner circumferential surface of the housing.

4. The spark plug for the internal combustion engine according to claim 2, wherein, the insulator has a locked step portion that is locked in a plug axial direction relative to a locking step portion disposed on an inner peripheral side of the housing;

the high emissivity surface is formed closer to the proximal side than the locked step portion is; and the high emissivity surface is disposed on at least a part of the portion facing the inner circumferential surface of the housing.

5. The spark plug for the internal combustion engine according to claim 1, wherein, the housing has a reduced diameter portion with an inner diameter smaller than all other portions at the distal end portion of the housing;

the ground electrode is disposed so as to protrude from a distal end face of the reduced diameter portion; and the ground electrode is formed in a ring shape so that the inner peripheral surface of the ground electrode faces the outer peripheral surface of the center electrode.

6. The spark plug for the internal combustion engine according to claim 2, wherein, the housing has a reduced diameter portion with an inner diameter smaller than all other portions at the distal end portion of the housing;

the ground electrode is disposed so as to protrude from a distal end face of the reduced diameter portion; and the ground electrode is formed in a ring shape so that the inner peripheral surface of the ground electrode faces the outer peripheral surface of the center electrode.

7. The spark plug for the internal combustion engine according to claim 3, wherein, the housing has a reduced diameter portion with an inner diameter smaller than all other portions at the distal end portion of the housing;

the ground electrode is disposed so as to protrude from a distal end face of the reduced diameter portion; and the ground electrode is formed in a ring shape so that the inner peripheral surface of the ground electrode faces the outer peripheral surface of the center electrode.

8. The spark plug for the internal combustion engine according to claim 4, wherein, the housing has a reduced diameter portion with an inner diameter smaller than all other portions at the distal end portion of the housing;

the ground electrode is disposed so as to protrude from a distal end face of the reduced diameter portion; and the ground electrode is formed in a ring shape so that the inner peripheral surface of the ground electrode faces the outer peripheral surface of the center electrode.

* * * * *